US006821411B2

(12) United States Patent
Baca et al.

(10) Patent No.: US 6,821,411 B2
(45) Date of Patent: Nov. 23, 2004

(54) STEAM INJECTION SYSTEM ON THE TLE CONES OF A HYDROCARBON CRACKING FURNACE

(75) Inventors: Brian D. Baca, Sweeny, TX (US); Danna L. Kutach, Pearland, TX (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 421 days.

(21) Appl. No.: 09/931,437

(22) Filed: Aug. 16, 2001

(65) Prior Publication Data

US 2003/0035766 A1 Feb. 20, 2003

(51) Int. Cl.[7] ..... C10G 9/36

(52) U.S. Cl. ..... 208/130; 422/194; 422/187; 422/207; 208/47; 208/48 R

(58) Field of Search ..... 208/48 R, 47, 208/130; 422/187, 207, 194

(56) References Cited

U.S. PATENT DOCUMENTS 3,364,983 A 1/1968 Krinov et al.
3,574,781 A 4/1971 Racine et al.
4,073,302 A 2/1978 Jones
4,097,544 A 6/1978 Hengstebeck
4,366,003 A 12/1982 Korte et al.
4,384,160 A 5/1983 Skraba
4,397,740 A 8/1983 Koontz
5,324,486 A 6/1994 Russo
5,826,647 A 10/1998 Engelhardt et al.
5,972,206 A * 10/1999 Lenglet et al. ..... 208/130
6,053,187 A 4/2000 Altomonte

* cited by examiner

*Primary Examiner*—Walter D. Griffin
*Assistant Examiner*—James Arnold, Jr.
(74) *Attorney, Agent, or Firm*—Williams, Morgan & Amerson, P.C.

(57) ABSTRACT

A method is provided to inject steam into a hydrocarbon effluent passing through a transfer line exchanger (TLE) of a hydrocarbon cracking furnace to reduce the formation of a coke material on the TLE tubesheet. The apparatus that injects the steam is also provided to deliver a distributed steam flow in the low resonance area of the TLE cone.

10 Claims, 1 Drawing Sheet

STEAM INJECTION SYSTEM ON THE TLE CONES OF A HYDROCARBON CRACKING FURNACE

Figure 1:
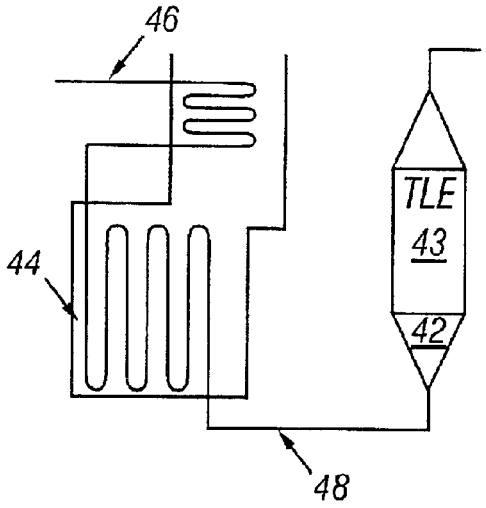

This invention relates to a method to reduce formation of a coke material on a Transfer Line Exchanger (TLE exchanger) tubesheet by injecting steam into a hydrocarbon effluent from a hydrocarbon cracking furnace. This invention particularly relates to an apparatus for injecting steam into a hydrocarbon effluent from a hydrocarbon cracking furnace to reduce the coke material from forming on a TLE exchanger tubesheet at the outlet of the hydrocarbon cracking furnace.

BACKGROUND OF THE INVENTION

Ethylene is produced by cracking a hydrocarbon feed to produce a hydrocarbon effluent comprising ethylene and numerous other products such as, for example, propylene, butadiene, and benzene. The hydrocarbon cracking is conducted at extreme temperatures, and the hydrocarbon effluent produced then flows from the hydrocarbon cracking heater to the TLE to be cooled. In addition to producing ethylene and other products, a coke material is also produced. The coke material can adhere to a TLE exchanger tubesheet, and eventually will require that the hydrocarbon cracking furnace be shut down in order to mechanically clean the TLE exchanger tubesheet. The adhesion of the coke material is partially because the hydrocarbon effluent velocity is lower on the outer edges of the TLE cone than in the center. Therefore, the reduction in velocity can cause be hydrocarbon effluent to swirl or form eddies, thereby causing the hydrocarbon effluent to have a higher residence time. Generally, when the TLE exchanger is removed for cleaning, up to 20% of the TLE exchanger tubesheet is covered with coke material thus restricting heat transfer and thereby reducing the efficiency of the hydrocarbon cracking furnace.

An inventive solution has been discovered to substantially reduce the coke material from forming on the TLE tubesheet.

SUMMARY OF THE INVENTION

It is an object of this invention to provide a method for reducing formation of a coke material on a TLE exchanger tubesheet of a hydrocarbon cracking furnace.

It is another object of this invention to provide an apparatus for injecting steam to reduce the formation of coke material on a TLE exchanger tubesheet of a hydrocarbon cracking furnace.

In accordance with this invention, an apparatus to inject steam into a hydrocarbon effluent passing through the TLE cone of a hydrocarbon cracking furnace is provided. The apparatus comprises:

(a) at least one injection probe, which is connected at an angle in a range of about 30 to about 60 degrees to the TLE cone; and (b) a distribution nozzle, which is connected to the end of said injection probe, wherein the injection probe and distribution nozzle protrude into the TLE cone by a distance in the range of about 1% to about 10% of the radius of the TLE cone.

In further accordance with this invention, a method to inject steam into a TLE cone of a hydrocarbon cracking furnace to reduce formation of a coke material on the TLE exchanger tubesheet is also provided. The method comprises:

(a) injecting steam through at least one injection probe wherein the injecting is accomplished by the apparatus described previously.

BRIEF DESCRIPTION ON THE DRAWINGS

FIG. 1. An overall view of the flow from a hydrocarbon cracking furnace to a TLE exchanger is provided.

Figure 2:
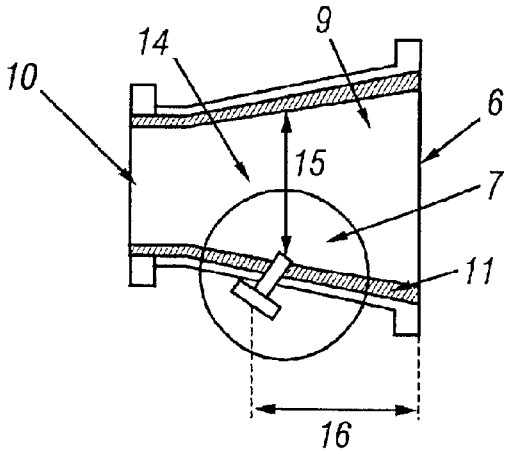

FIG. 2. A side view of a TLE cone is provided.

Figure 3:
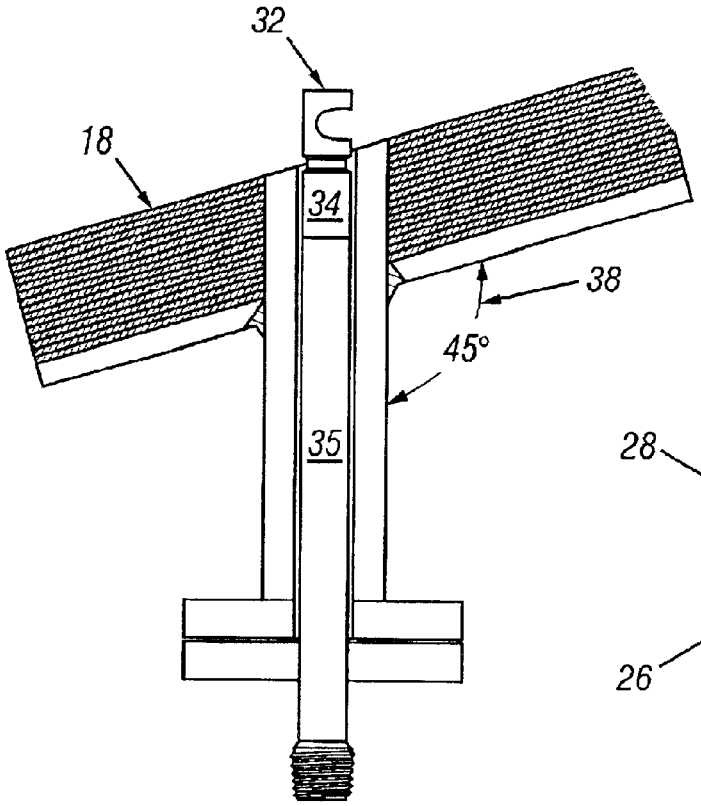

FIG. 3. A detailed depiction of one embodiment of the apparatus illustrating the injection probe position within the wall of the TLE cone and the distribution nozzle used to inject the steam into the hydrocarbon effluent.

Figure 4:
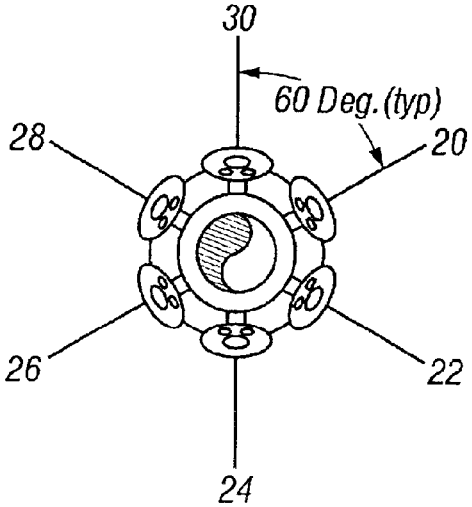

FIG. 4. A detailed depiction of the preferred mode of operation of the apparatus involving six injection probes that are 60 degrees apart around the circumference of the TLE cone.

DETAILED DESCRIPTION OF THE INVENTION

To reduce the formation of a coke material on a TLE tubesheet 6, an apparatus to inject steam into a hydrocarbon effluent 48 passing through a TLE cone 42 of a hydrocarbon cracking furnace 44 is provided, the apparatus comprising:

(a) at least one injection probe 35, which is connected at an angle 38 in a range of about 30 to about 60 degrees to the TLE cone 42; and (b) a distribution nozzle 32, which is connected to the end 34 of the injection probe 35, wherein the injection probe 35 and distribution nozzle 32 protrude into the TLE cone 42 by a distance of in the range of about 1% to about 10% of the radius of the TLE cone 15.

The production of ethylene is accomplished by subjecting a hydrocarbon feed 46 to severe temperature in a hydrocarbon cracking furnace 44. The temperature ranges from about 150° F. to about 1700° F. A hydrocarbon effluent 48 exits the hydrocarbon cracking furnace 44 at this severe temperature, and it then is quenched to a temperature below 1000° F. through the use of a TLE exchanger 43. A coke material can be formed in the TLE cone 42 when the hydrocarbon effluent 48 is entering the TLE exchanger 43. The coke material also can form on the TLE exchanger tubesheet 6. This formation of coke material can eventually plug the TLE exchanger 43 requiring the hydrocarbon cracking furnace 44 to shut down for maintenance.

The coke material is formed more rapidly in low flow areas 7 and 9. Low flow areas 7 and 9 are found on the outer edge of the TLE cone 42. The higher flow area is in the center of the TLE cone 14 and the center of the hydrocarbon effluent 10. Injecting steam into the low flow areas 7 and 9 can decrease the resonance time that the hydrocarbon effluent takes to flow through the TLE cone 42. The steam injection also quenches the hydrocarbon effluent. The result is less coke material formed on the TLE tubesheet 6.

The apparatus comprises at least one injection probe 35 and at least one distribution nozzle 32. The injection probe 35 is connected to the TLE cone 42 making an angle 38 in a range of about 30 degrees to about 60 degrees as it protrudes through the refractory lining of the TLE cone 11 in FIG. 2 and 18 in FIG. 3. Preferably, the angle 38 is 45 degrees. Preferably, the injection probe 35 is located at a distance 16 from the TLE tubesheet 6 in a range of about 12 inches to about 36 inches, most preferably, 12 inches to 24 inches. A distribution nozzle 32 is connected to the end of the injection probe 34 to distribute the steam flow. The injection probe 35 and distribution nozzle 32 protrude into the TLE cone 42 by about 1% to about 10% of the radius of 15 the TLE cone 42. Preferably, the injection probe 35 and distribution nozzle 32 protrude about 1% to about 3% of the radius 15 of the TLE cone 42. In addition, the location of the injection probe 35 and distribution nozzle 32 can prevent erosion of the distribution nozzle 32 due to the low velocity of the hydrocarbon effluent. The hydrocarbon effluent 48 flow rate is increased by injecting steam in the low velocity areas 7 and 9 of the TLE cone 42 downstream of the injection probe 35, which ultimately reduces the formation of the coke material on the TLE exchanger tubesheet 6. The distribution nozzle 32 injects steam in the direction of the hydrocarbon effluent 48 flow. Preferably, there are six injection probes 20, 22, 24, 26, 28 and 30 at an angle of about 60 degrees apart around the circumference of the TLE cone 42.

A method to inject steam in a hydrocarbon effluent passing through the TLE cone of a hydrocarbon cracking furnace 44 to reduce formation of a coke material on the TLE exchanger tubesheet 6 is provided. The method comprises:

(a) injecting steam through at least one injection probe wherein said injecting is accomplished by the apparatus described previously.

A sufficient amount of steam must be injected to reduce coke material from forming on the TLE tubesheet 6. Generally, the amount of steam ranges from about 0.5% to about 10% of the flow of the hydrocarbon effluent 48. Preferably, the amount of steam injected is in a range of about 1% to about 3% of the flow of the hydrocarbon effluent. The pressure of the steam injected into the hydrocarbon effluent 48 is in a range of about 30 psig to about 150 psig. Preferably, the pressure of the steam injected into the hydrocarbon effluent 48 is in a range of about 30 psig to about 50 psig.

EXAMPLE

The following example is provided to assist a person skilled in the art with further illustrations of this invention. This example is intended to be illustrative of the invention but is not meant to be construed as limiting the reasonable scope of the invention.

Example #1

In a commercial test, an apparatus to inject steam to reduce coke material from forming on the TLE tubesheet of a hydrocarbon cracking furnace was tested. The steam was injected using six injection probes and a steam rate of about 0.5 to about 3% of the total flow of the hydrocarbon effluent flow rate. The pressure of the steam used was in a range of about 30 psig to about 60 psig, preferably in a range of about 50 psig. The injection probes on the TLE cone were located 14 inches from the TLE tubesheet. During the test, the pressure increase at the TLE tubesheet was measured. An increase in pressure of less than 5 psi was observed. Generally, during normal operation without steam injection, a pressure increase in a range of about 8 psi to about 17 psi due to coke material forming on the TLE tubesheet is observed. The TLE was able to operate up to 50% longer using the steam injection than under normal conditions without the steam injection.

What is claimed is:

1. An apparatus to inject steam into a hydrocarbon effluent passing through a TLE cone of a hydrocarbon cracking furnace, said apparatus comprising:

(a) at least one injection probe, which is connected at an angle in a range of about 30 to about 60 degrees to said TLE cone; and (b) a distribution nozzle, which is connected to an end of said injection probe, wherein said injection probe and distribution nozzle protrude into said TLE cone by a distance in the range of about 1% to about 10% of the radius of the TLE cone.

2. An apparatus as recited in claim 1 wherein said angle is about 45 degrees.

3. An apparatus as recited in claim 2 wherein there are six injection probes located 60 degrees apart around the circumference of said TLE cone.

4. An apparatus as recited in claim 1 whereby said injection probe and distribution nozzle protrude into said TLE cone by a distance of about 1% to about 3% of the radius of the TLE cone.

5. An apparatus as recited in claim 1 wherein said injection probe is located at a distance from the TLE tubesheet in a range of about 12 to about 36 inches.

6. A method to inject steam in a hydrocarbon effluent passing through the TLE cone of a hydrocarbon cracking furnace to reduce formation of a coke material on the TLE exchanger tubesheet, the method comprising:

injecting steam rough at least one injection probe wherein said injecting is accomplished by said apparatus in claim 1.

7. A method of injecting steam as recited in claim 6 wherein the steam pressure is in a range of about 30 psig to about 150 psig.

8. A method of injecting steam as recited in claim 7 wherein the steam pressure is in a range of about 30 psig to about 50 psig.

9. A method of injecting steam as recited in claim 6 wherein steam flow is in an amount ranging from about 0.5% to about 10% of the flow of the hydrocarbon effluent.

10. A method of injecting steam as recited in claim 9 wherein steam flow is in an amount in a range of about 1% to about 3% of the flow of the hydrocarbon effluent.

* * * * *

UNITED STATES PATENT AND TRADEMARK OFFICE

CERTIFICATE OF CORRECTION

PATENT NO. : 6,821,411 B2 
DATED : November 23, 2004
INVENTOR(S) : Brian D. Baca and Danna L. Kutach It is certified that error appears in the above-identified patent and that said Letters Patent is hereby corrected as shown below:

Column 4,
Line 37, delete “rough” and insert -- through --.

Signed and Sealed this

Nineteenth Day of April, 2005

JON W. DUDAS
*Director of the United States Patent and Trademark Office*